United States Patent [19]

Range

[11] 4,429,861

[45] Feb. 7, 1984

[54] TOBACCO LEAF GRADING AND STRIPPING APPARATUS

[76] Inventor: Alfred P. Range, Rte. 14, Box 596, Johnson City, Tenn. 37601

[21] Appl. No.: 208,244

[22] Filed: Nov. 19, 1980

[51] Int. Cl.[3] ..... B25B 1/20

[52] U.S. Cl. ..... 269/40; 269/69; 269/296; 269/909; 269/37; 211/205; 209/704

[58] Field of Search ..... 269/37, 69, 296, 909, 269/40; 209/704; 211/45, 207, 208, 205; 248/407, 354 P; 414/10, 11

[56] References Cited

U.S. PATENT DOCUMENTS

| | | | |
|---|---|---|---|
| 2,595,837 | 5/1952 | Freeman | 209/704 |
| 2,893,677 | 7/1959 | Dannenburg | 211/207 X |
| 3,077,985 | 2/1963 | Anderson | 209/704 |
| 3,358,951 | 12/1967 | Carter | 248/407 X |
| 3,734,301 | 5/1973 | Rastocny | 211/205 |

*Primary Examiner*—Robert C. Watson

[57] ABSTRACT

Disclosed is a tobacco leaf grading and stripping apparatus or rack which is easily movable to desired locations accessible to the cured tobacco, and comprises base means, tobacco stick hanger means having a generally wheel-shaped, polygonal periphery, rotatably mounted on the base means and comprising a plurality of individual arms extending outwardly from stanchion means in a spoke-like manner, and each of the arms being provided on its outer portions with support means adapted to receive and support one end of a loaded tobacco stick such that adjacent support means can support jointly the whole stick in a generally horizontal posture. Any number of arms can be provided for supporting any desired number of loaded tobacco sticks, about four or five sticks being preferred. In using this apparatus, one or more operators can be positioned at convenient locations around the periphery of the hanger means supporting the loaded tobacco sticks, and the hanger means then rotated as necessary to bring the tobacco stalks into a convenient position for stripping. The apparatus thereby allows the operator to employ both hands in stripping the leaves and greatly reduces the need for movement away from his work station. As the stalks become completely stripped, the hanger means may be rotated to bring that particular stick to a station where a new loaded stick can be placed on the hanger without interfering with the stripping in progress on the other sticks.

2 Claims, 2 Drawing Figures

TOBACCO LEAF GRADING AND STRIPPING APPARATUS

Figure 1:
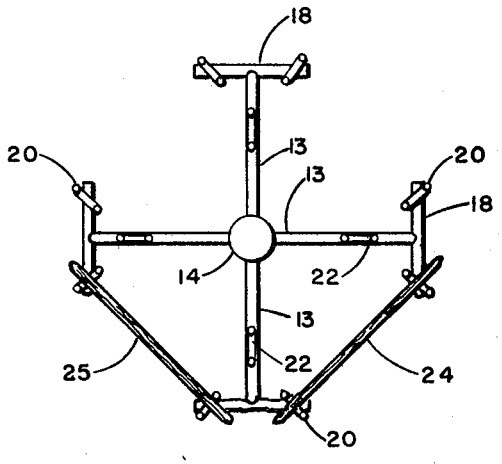

This invention concerns tobacco leaf grading and stripping devices and particularly concerns apparatus for supporting a plurality of loaded tobacco sticks in position for stripping of the leaves for subsequent handing or baling. Such tobacco sticks are shown, for example, in U.S. Pat. No. 3,077,985.

In tobacco leaf preparation, one of the most time-consuming and laborious operations is stripping the cured leaves from their stalks selectively according to each of several grades. Typically, the tobacco sticks having skewered thereon 4 or 5 tobacco stalks are taken from supporting poles in the curing barn and either laid on a work table or hung on supports of a height suitable for manual stripping of the leaves. A worker then strips each type of leaf, principally tip, lug, or bright, and places them in separate piles until enough are gathered to form a hand of that leaf type. The hands, about 20 leaves, are tied with a tie leaf, and the hands are then laid by the worker in a circular pattern (bundle) onto a tobacco basket, one basket for each leaf type. Another typical technique is for two or three operators to work on one stick, each operator stripping one type of leaf, handing the same and stacking onto a basket, after which the stripped stick is replaced with a loaded one. With each of these and other stripping techniques commonly used, as disclosed, for example, in the aforementioned U.S. Pat. No. 3,077,985, there is considerable wasted motion as the worker must move about, that is, from stalk to stalk and then to the basket as a hand is completed. In some operations, each stalk is individually positioned at a work station somewhat remote from the loaded tobacco stick. It is apparent that such worker motion represents an enormous amount of wasted effort when translated to stripping an entire tobacco curing barn and becomes almost a prohibition against profitable tobacco farming.

Objects, therefore, of the present invention, are: to markedly reduce the time and physical effort required for stripping and bundling tobacco leaves; to provide a means for holding several tobacco sticks in a convenient position for stripping by one or several workers; to provide such means whereby several workers past whom each loaded stick passes can strip a select type of leaf and hand and bundle at the same station with a minimum of physical motion; to provide such means whereby new loaded sticks can be placed rapidly and conveniently in stripping position; and to provide such a means which is easily movable to desired locations either inside or outside the curing barn.

These and further objects hereinafter appearing have been attained by the present invention through the discovery of a unique rotatable tobacco leaf grading and stripping apparatus or rack which in accomplishing the above objectives can support and move unstripped stalks to several stripping stations simultaneously, position them conveniently for stripping, move the stalks onto another station for stripping of a different grade of leaf, and then move stripped stalks to an unloading and loading station, all without requiring the workers to move from their work stations.

Figure 2:
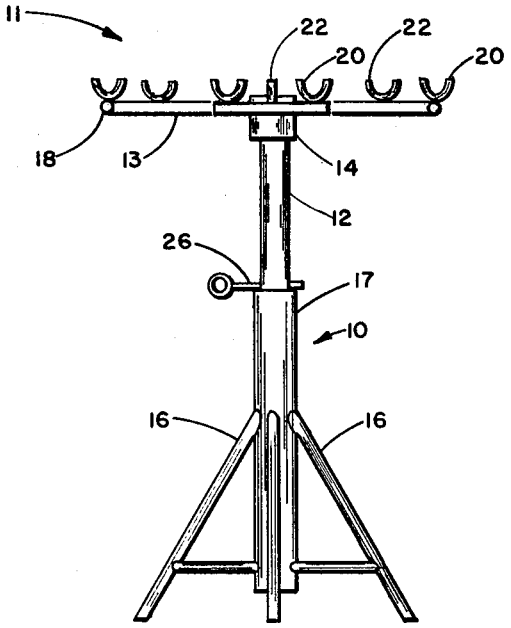

The invention will be further understood from the following description and drawing wherein:

FIG. 1 is a top view of the tobacco grading and stripping apparatus or rack; and FIG. 2 is a side view of the apparatus of FIG. 1.

Referring to the drawings, the rack is shown to have base means generally designated 10, and tobacco stick hanger means generally designated 11 comprising stanchion means 12 slidably, rotatably mounted within or without the base means 10, a plurality of arms 13 secured, hub-like, to the stanchion means by any means such as welding, brazing or the like, and tobacco stick support means, hereinafter described, on the outer portions of each of said arms. For convenience in attaching the arms, as shown, an enlarged end or hub 14 may be provided on said stanchion means. The base means may be provided with a plurality of stabilizing members arrayed in any fashion thereon, such as legs 16 welded or otherwise secured to the upright portion 17 of the base.

The arms 13 are provided with tobacco stick support means comprising cross members 18 disposed at substantially but not critically right angles thereto, and provided with cradle means comprising two generally concave tobacco stick supporting cradles 20 which are arrayed generally in alignment with the adjacent cradles of adjacent support means. Also provided on arms 13 are additional cradles 22 for supporting short sticks which may result from breaking.

The invention is defined as a tobacco leaf grading and stripping rack comprising base means, and tobacco stick hanger means rotatably mounted on said base means and comprising a plurality of individual arms extending outwardly from stanchion means in a spoke-like manner, each of said arms being provided on its outer portions with support means adapted to receive and support the end of a tobacco stick such that adjacent support means can support jointly a loaded tobacco stick in a generally horizontal posture. In preferred embodiments of the present invention, the axes of adjacent cradle means of adjacent cross-members are in substantial alignment for receiving and supporting both ends of a tobacco stick, additional cradle means are provided on the arms at one or more positions intermediate the cross-members and the stanchion means for supporting short tobacco sticks, the stanchion means is also slidable axially on the base means and cooperating adjustable shoulder means on the stanchion means and the base means allows for height adjustment for the hanger means, and the cradle means are substantially U-shaped members opening upwardly to allow smooth rotation of the sticks therein in an outward and upward direction to bring the tip or end of the stalks toward the operator for convenient stripping without requiring bending over.

In operation of the particular embodiment of the rack as shown in the drawing, four tobacco sticks, each from about 5 to about 6 feet in length and carrying about 4 or 5 tobacco stalks skewered at their bases thereon, are placed on the rack with the ends of each stick resting in the aligned cradles of adjacent cross members, as shown in FIG. 1 by sticks 24 and 25. If desired one or more operators may be positioned in front of each loaded stick and provided with a basket for receiving the completed tobacco hands. As an operator selects and strips the grade of leaf he wants, he may rotate the hunger means to position a new stalk or loaded stick at his work station without having to move about. Where experienced operators are involved, the stripping speed will be quite consistent for each, and rotation of the hanger means will not present any difficulty to the other operators. A stop member 26 such as an eye bolt may be provided for insertion through spaced holes in stanchion 12 to provide cooperating shoulder means for height adjustment to prevent the leaves from contacting the ground and to allow for either the standing or the sitting operator position. It is particularly noted that with the present device and in particular the arrangement of cross-members 18, generally the tobacco sticks and stalks when positioned on the rack do not have to overlap or interfere with each other as shown by sticks 24 and 25, and loading and unloading of the sticks are thereby facilitated. An important feature of the present apparatus is that the loaded sticks when supported in the cradles can themselves rotate in the cradles to allow the operator to rotate the stalks outwardly and upwardly to position them more conveniently for stripping the ends or tips.

The present invention is, of course, adaptable to many variations of size and shape of its components. For example, any convenient number of arms may be provided and are limited only by space considerations. Also, the cradles 20 and 22 may be of a V or other convenient shape. Arms 13 and cross-members 18, as base 10 and stanchion 12, are conveniently made from sections of iron or steel pipe but, of course, may also be of aluminum, wood, or other reasonably strong material. In an alternative embodiment, the hub portion 14 of the stanchion 12 may be made the rotatable member by means, for example, of a rotatable fit of the end of the stanchion 12 within a recess in the hub. It is noted that with the structure shown, which is preferred, the hanger means may be rotated as desired even though stop member 26 is in its operative position. As indicated above, the stanchion, as a variation, may be the receiving member, within its bore, for the upright portion 17 of the base. Also, as indicated above, cross-members 18 do not have to be exactly at right angles to the arms and may have any configuration such as a generally horizontal triangular plate, disc or the like affixed to the ends of the arms. The important element is that the cradles are positioned on the cross-members such that the axes of adjacent cradles are reasonably, but not necessarily perfectly, in alignment for easy reception and rotation of the sticks therein with minimal likelihood of binding or jamming.

The invention has been described in detail with particular reference to preferred embodiments thereof, but it will be understood that variations and modifications can be effected within the spirit and scope of the invention.

I claim:

1. A tobacco leaf grading and stripping apparatus comprising base means, and tobacco stick hanger means rotatably mounted on said base means and comprising a plurality of individual arms extending outwardly from stanchion means in a spoke-like manner a distance close to or beyond the outer periphery of said base means, each of said arms being provided on its outer portions with support means, each said support means comprising a cross-member having cradle means thereon, the axes of adjacent cradle means of adjacent cross-members being in substantial alignment for jointly receiving and supporting both ends of a loaded tobacco stick in a generally horizontal posture.

2. The apparatus of claim 1 wherein cradle means are also provided on said arms at one or more positions intermediate the said cross-members and said stanchion means for supporting short tobacco sticks in a generally horizontal posture.

* * * * *